United States Patent [19]

Jariwala

[11] 4,044,278

[45] Aug. 23, 1977

[54] ELECTRON GUN CATHODE HEATER FILAMENT ELECTRICAL CONNECTION AND SUPPORT SYSTEM

[75] Inventor: Praveen K. Jariwala, Hammondsport, N.Y.

[73] Assignee: Westinghouse Electric Corporation, Pittsburgh, Pa.

[21] Appl. No.: 647,026

[22] Filed: Jan. 7, 1976

[51] Int. Cl.[2] ..... H01J 29/50; H01J 29/04

[52] U.S. Cl. ..... 313/417; 313/409; 313/457

[58] Field of Search ..... 313/409, 417, 451, 456, 313/457, 243, 272, 292

[56] References Cited

U.S. PATENT DOCUMENTS 3,873,876 3/1975 Yamauchi ..... 313/417 X

*Primary Examiner*—Eugene R. LaRoche

*Attorney, Agent, or Firm*—W. G. Sutcliff

[57] ABSTRACT

An improved cathode heater filament electrical connection and support system for a three in-line electron gun color television picture tube. A pair of identical, thin, electrically conductive support rails electrically connect in parallel the filament leads of the three cathode heaters, with the support rails being spaced apart and disposed parallel to each other and aligned with the in-line direction and respectively offset on opposite sides from an in-line plane passing through the three cathode centers. A pair of integral tabs extend from each of the support rails to permit supportive connection to a plurality of insulating rods.

3 Claims, 4 Drawing Figures

FIG. 1
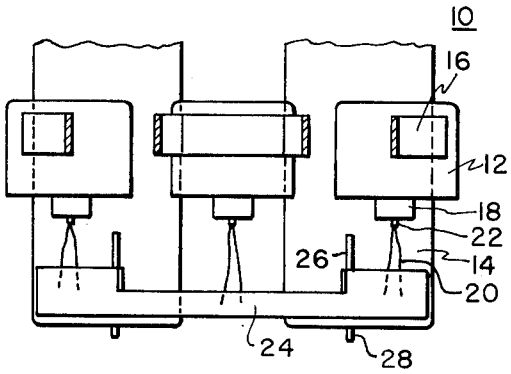
FIG. 3
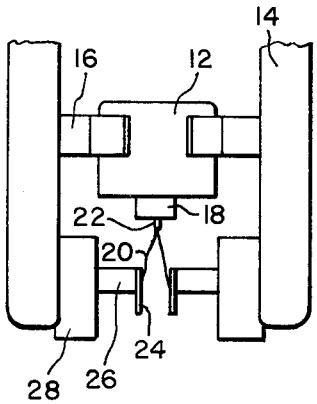
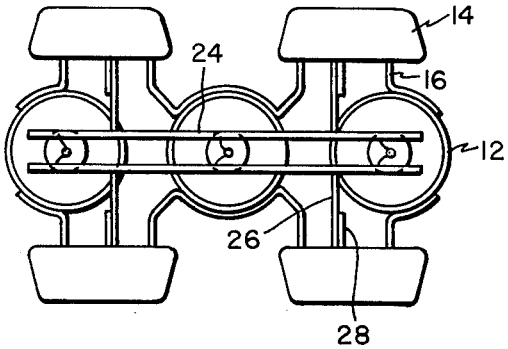
FIG. 2
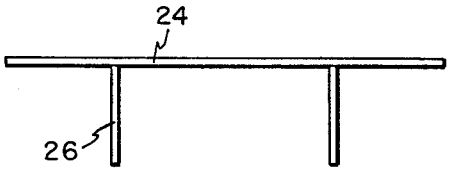
FIG. 4

ELECTRON GUN CATHODE HEATER FILAMENT ELECTRICAL CONNECTION AND SUPPORT SYSTEM

BACKGROUND OF THE INVENTION

The present invention relates to color television picture tubes, and more particularly to such picture tubes which have three in-line electron guns. Such in-line electron gun picture tubes facilitate design and operation of the electron beam deflection system utilized in generating the picture tube display. The electron gun assemblies for such tubes are generally very similar to the delta electron gun systems used in other color television picture tubes, in that the various aligned portions of the electron gun are supported from a plurality of insulated support rods which serve to support the electron gun portions in accurate alignment and positioning relative to each other. It is largely a matter of choice as to whether the cathode heaters which are the indirect means of heating the emissive cathode portion are connected electrically in series or parallel. The cathode heater is typically a coiled coil which is inserted and disposed within a tubular-type cathode sleeve which is heated and one end surface of which is coated with emissive material. This cathode sleeve must be accurately positioned and spaced relative to the G1 cathode grid which is fixed in position and supported from the insulator rods which form a supportive cage-like assembly about the electron guns. The coil ends or filament lead in conductors for the cathode heaters extend down outside of the cathode sleeve and are connected to electrical connection and support means which are in turn supported from the insulating support rods. It is important that the filament connection and support means by very stable and rigid since the filaments are very small diameter wires and this connection point is a critical point in ensuring long-lived operation of the entire picture tube.

In the manufacture and design of electron gun components, it is very important to minimize the total number of parts and to adapt the design to the optimum fabrication technique which usually means a minimum number of weld connections and alignment steps. It is desirable that a cathode heater filament electrical connection and support system comprise a minimum number of interchangeable parts which are easily fabricated together in a minimum number of steps during final electron gun fabrication.

SUMMARY OF THE INVENTION

An improved cathode heater filament electrical connection and support system is described for a three inline electron gun color television picture tube. The cathode heaters of each of the electron guns of such in-line electron gun picture tubes have filament leads which extend from the rear end of the electron gun assemblies. The cathode heaters are electrically connected in parallel and are supported from a plurality of insulated support rods. The support rods are disposed about and support in aligned relationship the various electron gun assembly parts. The present improvement comprises a pair of identical, thin, electrically conductive support rails which are supported from the plurality of insulating support rods. The support rails are spaced apart and disposed parallel to each other and are aligned with the in-line direction of the guns and respectively offset on opposite sides from an in-line plane passing through the three cathode gun centers. A pair of integral tabs extend from each of the support rails at an angle normal to the support rail and away from the parallel other support rail. The integral tabs are connected to support tabs which are embedded in and extend from the insulative support rod. One cathode heater filament from each cathode heater is electrically connected to one of the support rails, and the other filament from each cathode heater is connected to the other support rail. The support rails preferably comprise thin, ribbon-like members with the integral tabs being formed as deformed slitted portions of the ribbon-like rail.

BRIEF DESCRIPTION OF THE DRAWINGS

FIG. 1 is a partial, side elevational view of a three in-line electron gun assembly, in which only the G1 cathode portion end of the electron gun is shown;

FIG. 2 is a view of the partial assembly of FIG. 1 viewed from behind or below the electron gun;

FIG. 3 is a view of the assembly of FIG. 1 from the side to further illustrate the relationship of the elements; and FIG. 4 is a plan view of the support rail element by itself.

DESCRIPTION OF THE PREFERRED EMBODIMENTS

The invention can be best understood by reference to the illustrative drawings wherein, in FIG. 1 a partial view of three in-line electron gun assemblies 10 is seen. The G1 electrode 12 of each of the in-line electron gun assemblies comprises a generally cylindrical body which is closed at one end with an electron aperture directed through the closed end. The G1 electrodes 12 are supported from insulative multi-formed glass support rods 14 via connector means 16 which are embedded in the insulator rods 14 are tack-welded to the exterior of the G1 electrode. The connector means 16 are seen more clearly in FIGS. 2 and 3. FIG. 2 clearly shows in-line nature or alignment of the electron gun with a central plane passing through the center of each of the electron gun assemblies. In this embodiment, four insulator rods are positioned to form a support cage to which all the individual portions of the electron gun assemblies are mounted by embedding support tabs. A generally tubular cathode sleeve member 18 is seen extending from the rear end of each of the G1 electrodes. The cathode sleeve 18 is centered within the G1 electrode and supported therein by means not seen in the drawings but which are well known conventionally. The far end of the cathode sleeve is closed at one end and an electron emissive coating is provided on the exterior surface. A coiled-coil cathode heater not seen is inserted within the cathode sleeve and filamentary leads 20 extend from the ends of this cathode heater which is illustrated generally as coil 22 in FIG. 2.

A pair of identical, thin, electrically conductive support rails 24 are utilized to connect the filament leads of the cathode heater of the in-line electron gun assemblies in parallel electrical relationship and also to support the cathode heater within the cathode sleeve. A support rail 24 is seen individually in a plan view of FIG. 4 and comprises a thin, rigid ribbon of metal typically about 10 mil thickness stainless steel and slightly less than about 1 inch in length. A pair of connective tabs 26 are integrally formed from portions of the support rail by forming a slit which extends halfway up the height of the support rail approximately along the middle line of the support rail and then by slitting the support rail along the direction of extension of the rail. The tabs 26 are then deformed approximately at an angle normal to the principal direction of the extension of the support rail. The two support rails 24 utilized in the electron gun assembly are actually identical and are spaced apart and disposed in parallel relationship to each other and aligned with the in-line direction of the electron guns. The end of each of the support rails 24 is respectively offset on opposite sides from an in-line plane passing the three cathode centers. The interal tab portion 26 which extend from each support rail extend away from the parallel other support rail to facilitate connection to support ribbon tabs 28 with one such ribbon tab being embedded in each insulative rod 14 and connected to an individual support rail tab 26 as by spot welding. One filamentary lead 20 of each the cathode heaters 22 is connected to each of the support rails 24 as by spot welding to thereby parallel electrically connect the cathode heaters. The electrical lead-ins from the tube stem via when electrical connection to the outside circuitry is made can be connected them by spot welding to opposed ribbon tabs 28 to complete the electrical connection of the gun.

The support rails 24 with integrally formed tabs 26 are more easily formed with a minimum of waste and a minimum number of weld contacts needed during assembly.

The support rails 24 offer a large flat contact area generally parallel to the downward direction of extension of the filament leads 29, and this permits and ensures ease and reliability of spot welding of the filaments to the support rail.

I claim:

1. An improved cathode heater filament electrical connection and support system for a three in-line electron gun color television picture tube in which the cathode heaters of each of the electron guns have filament leads extending from the rear end of the electron gun assemblies and the cathode heaters are electrically connected in parallel and are supported from a plurality of insulative support rods which are disposed about and supporting the electron gun assembly parts, the improvement wherein a pair of identical, thin, electrically conductive support rails supported from the plurality of insulative support rods, which support rails are spaced apart and disposed parallel to each other and aligned with the in-line direction and respectively offset on opposite sides from an in-line plane passing through the three cathode centers, with a pair of integral tabs extending from each of the support rails, which integral tabs extend from the support rails at an angle normal to the support rail and away from the parallel other support rail, which integral tabs are connected to support tabs which are embedded in and extend from the insulative support rods, with one cathode heater filament from each cathode heater electrically connected to one of the support rails, and the other filament from each cathode heater connected to the other support rail.

2. The electrical connection and support system set forth in claim 1, wherein four symmetrically positioned insulative support rods support the support rails, with two such insulative support rods on each side of the in-line plane passing through the three cathode centers, which insulative support rods are between the central cathode and the end cathodes.

3. The electrical connection and support system set forth in claim 1, wherein the integral tabs are deformed slitted rail portions.

* * * * *